US009762012B1

(12) United States Patent
LeGros, Jr.

(10) Patent No.: US 9,762,012 B1
(45) Date of Patent: Sep. 12, 2017

(54) VEHICULAR ELECTRICAL ADAPTER CORD HAVING A STANDARD 110/120 VOLT RESIDENTIAL RECEPTACLE

(71) Applicant: Gus Roy LeGros, Jr., Lake Charles, LA (US)

(72) Inventor: Gus Roy LeGros, Jr., Lake Charles, LA (US)

( * ) Notice: Subject to any disclaimer, the term of this patent is extended or adjusted under 35 U.S.C. 154(b) by 0 days.

(21) Appl. No.: 15/179,999

(22) Filed: Jun. 11, 2016

(51) Int. Cl.
*H01R 31/06* (2006.01)
*H01R 31/02* (2006.01)

(52) U.S. Cl.
CPC ..... *H01R 31/06* (2013.01); *H01R 31/02* (2013.01)

(58) Field of Classification Search
CPC ..... H01R 25/003; H01R 31/02; H01R 31/06
USPC ..... 439/505, 502, 35
See application file for complete search history.

(56) References Cited

U.S. PATENT DOCUMENTS 3,641,472 A 2/1972 Phillips, Jr.
4,280,062 A * 7/1981 Miller ..... B60Q 1/305 174/72 A
5,160,852 A 11/1992 Charles et al.
5,162,720 A 11/1992 Lambert
5,234,360 A * 8/1993 Kramer, Jr. ..... H01R 25/003 439/367
5,737,168 A 4/1998 Baker
5,936,828 A 8/1999 Nolan et al.
5,982,643 A 11/1999 Phlipot
6,767,255 B1 * 7/2004 Croswell ..... H01R 25/003 439/106
6,965,818 B2 11/2005 Koenig et al.
7,057,108 B1 6/2006 Sodemann et al.
7,102,106 B2 9/2006 Khoury
7,229,302 B1 * 6/2007 Lai ..... H01R 25/003 439/214
7,235,741 B2 6/2007 Schnackenberg
D702,183 S 4/2014 Benedict et al.
8,767,379 B2 7/2014 Whitaker
(Continued)

OTHER PUBLICATIONS

Website: http://www.electricgeneratorsdirect.com/Camco-55025/p7426.htrnl?utm_source=google+shopping&utm_medium=shop+portals&utm_campaign=55025&gclid=COPVt7LY_MYCFUWPHwodkYolzQ Downloaded Jul. 26, 2015 Cameo Power Grip Series™ 50-Amp Power Maximizer (15-Amp Male & 30-Amp Male).
(Continued)

*Primary Examiner* — Gary Paumen
(74) *Attorney, Agent, or Firm* — Russ Weinzimmer & Associates, PC

(57) ABSTRACT

An electrical RV adapter cord includes: a male plug of a first amperage rating capable of connecting to a source of electricity via at least a load pole, a neutral pole, and a ground pole; a female receptacle of a second amperage rating, electrically connected to the male plug via a main cable, for connecting to the RV via at least a load receptacle, a neutral receptacle, and a ground receptacle; and a standard 110/120 volt residential receptacle having a load receptacle, a neutral receptacle, and a ground receptacle, the standard 110/120 volt residential receptacle being electrically connected to the male plug via an auxiliary cable, the 110/120 volt load receptacle being connected to a load pole of the male plug, the 110/120 volt neutral receptacle being connected to a neutral pole of the male plug, and the ground receptacle being connected to a ground pole of the male plug.

9 Claims, 6 Drawing Sheets

(56) References Cited

U.S. PATENT DOCUMENTS

| | | | | |
|---|---|---|---|---|
| 8,971,083 | B1 | 3/2015 | Johnson | |
| 2005/0141154 | A1 | 6/2005 | Consadori et al. | |
| 2012/0196475 | A1* | 8/2012 | Lin | H01R 25/003 439/505 |
| 2012/0295473 | A1* | 11/2012 | Chen | H01R 31/06 439/505 |
| 2015/0091494 | A1 | 4/2015 | Halpern et al. | |

OTHER PUBLICATIONS

Website: http://www.ecspremier.com/50-Amp-Male-Plug-to-30-Amp-RV-Female-Dogbone-Adapter-with-handles-and-Lighted-female-end-6744T__p__53.html Downloaded Jul. 26, 2015 50 Amp Male Plug to 30 Amp RV Female Dogbone Adapter with handles and Lighted female end (65744T).

Website: http://www.adventurerv.net/parkpower-adapter-50×30×32726.html?gclid=CjwKEAjwluetBRD98L639p35p0QSJACC8BIKN18uZPLVFhZuNwLShQb511xXQJa5ndlBo__15ao7SaRoC3erw__wcB&utm__campaign=partsfeed__ppc&utm__medium=cpc&utm__source=Froogle Downloaded Jul. 26, 2015 ParkPower "Y" Adapter.

Website: http://www.quail.com/SearchByKeyword.aspx?word=-30P&cx=014187687656199245433:jm-cykwzovi&cof=FORID:10&ie=UTF-8&q=-30P&sa=Search&gclid=CjwKEAjwluetBRD98L63-9p35p0QSJACC8BIKcMggrW3bAuXiro8LV3RKivjXq7Eg-WIOFs7GZI6yZahoCExjw__wcB Downloaded Jul. 26, 2015 Nema/Locking Nema.

Website: http://www.amazon.com/dp/B007B35VD0?psc=1 Downloaded Jul. 26, 2015 RV Plug to (2)50A 125/250V Locking Female Connectors.

Website: http://www.amazon.com/Connetk-Adapter-Female-Connector-3-Feet/dp/B003YDY89Y/ref=pd__sim__sbs__200__5?ie=UTF8&refRID=0F0G2JDQQCPCFD73AVG7 Downloaded Jul. 26, 2015 Conntek RV Y Adaptrer Cord with 50 Amp Male Plug To (2) 30 Amp RV Female Connector (3-Feet).

Website: http://www.rvwholesalers.com/parts/products/power-maximizer-50a-55-73031?gclid=CjwKEAjwueytBRCmpOyZ2L-xrG8SJADwH5c6g6toldoMoh1ZNMnRRfruajIDQ95gJCqHue0-xa3AGkBoCNqvm__wcB Downloaded Jul. 26, 2015 Power Maximizer 50A.

Website: http://www.rvwholesalers.com/parts/products/cheater-box-55-2755?taxon__id=86 Downloaded Jul. 26, 2015 Cheater Box.

* cited by examiner

PRIOR ART

PRIOR ART

VEHICULAR ELECTRICAL ADAPTER CORD HAVING A STANDARD 110/120 VOLT RESIDENTIAL RECEPTACLE

FIELD

This invention relates generally to electrical cords, and more particularly to electrical adapter cords for connecting a vehicle to a source of electricity.

BACKGROUND OF THE INVENTION

Recreational Vehicle (RV) parks and campgrounds provide power for RVs at individual RV sites or spaces. Power poles having power boards at these sites will generally supply electricity to an RV parked in the space via either a 50 Amp-style or a 30 Amp-style female receptacle that is connectable to the RV via an electrical cord having a male plug to engage the female receptacle of the power board, and a female receptacle to engage a male plug of the RV. If the male plug of the RV has a different amperage rating than the female receptacle of the power board, then it may be necessary to use an electrical adapter cord having a male plug and a female receptacle with different amperage ratings.

FIGS. 1 and 2 show two such prior art electrical adapter cords. FIG. 1 shows an electrical adapter cord 10 having a 30 Amp-style male plug 11 electrically connected via a cable 13 to a 50 Amp-style female receptacle 12. FIG. 2 shows an electrical adapter cord 10 having a 50 Amp-style male plug 14 electrically connected via a cable 13 to a 30 Amp-style female receptacle 15.

A power board may also provide standard 110/120 volt residential receptacles. However, even if the standard 110/120 volt residential receptacles are available, they are frequently damaged beyond useability. Thus, it may not be possible to power typical household appliances such as blenders, microwave ovens, or coffee machines without the use of an additional electrical adaptor cord having a standard 110/120 volt residential plug (such as a 30 AMP Male To 15 AMP Female RV Camper Power Electrical Adapter), or an additional power source having standard 110/120 volt residential plugs, such as a generator. Thus, the lack of standard 110/120 volt residential receptacles can be a source of inconvenience and increased expense.

SUMMARY OF THE INVENTION

The VEHICULAR ELECTRICAL ADAPTER CORD HAVING A STANDARD 110/120 VOLT RESIDENTIAL RECEPTACLE provides a way to conveniently power electrical devices requiring a standard 110/120 volt residential receptacle from an RV park power board that may not have any working built-in standard 110/120 volt residential receptacles. Rather than hoping that a power board will have a functional standard 110/120 volt residential receptacle, any power board of a power pole (regardless of whether or not it has a functional standard 110/120 volt residential receptacle) can be used to power an electrical device requiring a standard 110/120 volt residential receptacle using the same electrical adapter cord that connects the power pole to the RV. This provides the benefit of always having a power source for electrical devices requiring a standard 110/120 volt residential receptacle, while eliminating the necessity of additional electrical cords having a standard 110/120 volt residential plug (if the power board has functional standard 110/120 volt receptacles), additional adaptor cords such as the 30 AMP Male To 15 AMP Female RV Camper Power Electrical Adapter, or additional power sources such as a generator.

One general aspect of the invention is an electrical adapter cord for electrically connecting a vehicle to a 50 Amp source of electricity. The electrical adapter cord includes: a 50 Amp-style male plug capable of connecting to a 50 Amp source of electricity via two 50 Amp load poles, a neutral pole, and a ground pole; a 30 Amp-style female receptacle capable of connecting to the vehicle via a 50 Amp load receptacle, a 50 Amp neutral receptacle, and a ground receptacle; a main cable electrically connecting the 50 Amp-style male plug to the 30 Amp-style female receptacle; and a standard 110/120 volt residential receptacle having a 110/120 volt load receptacle, a 110/120 volt neutral receptacle, and a ground receptacle, the standard 110/120 volt residential receptacle being electrically connected to the 50 Amp-style male plug via an auxiliary cable, such that the 110/120 volt load receptacle is connected to a first 50 Amp load pole of the 50 Amp-style male plug, the 110/120 volt neutral receptacle is connected to the neutral pole of the 50 Amp-style male plug, and the ground receptacle is connected to the ground pole of the 50 Amp-style male plug.

In some embodiments, the electrical adapter cord also includes: a second standard 110/120 volt residential receptacle having a second 110/120 volt load receptacle, a second 110/120 volt neutral receptacle, and a second ground receptacle, the second standard 110/120 volt residential receptacle being electrically connected to the 50 Amp-style male plug via the auxiliary cable, such that the second 110/120 volt load receptacle is connected to the first 50 Amp load pole of the 50 Amp-style male plug, the second 110/120 volt neutral receptacle is connected to the neutral pole of the 50 Amp-style male plug, and the second ground receptacle is connected to the ground pole of the 50 Amp-style male plug.

In some embodiments, the electrical adapter cord also includes: third and fourth standard 110/120 volt residential receptacles electrically connected to the 50 Amp-style male plug via a second auxiliary cable.

In some embodiments, the electrical adapter cord also includes: a second standard 110/120 volt residential receptacle having a second 110/120 volt load receptacle, a second 110/120 volt neutral receptacle, and a second ground receptacle, the second standard 110/120 volt residential receptacle being electrically connected to the 50 Amp-style male plug via a second auxiliary cable, such that the second 110/120 volt load receptacle is connected to a second 50 Amp load pole of the 50 Amp-style male plug, the second 110/120 volt neutral receptacle is connected to the neutral pole of the 50 Amp-style male plug, and the second ground receptacle is connected to the ground pole of the 50 Amp-style male plug.

In some embodiments, the main cable electrically connects the 50 Amp-style male plug to the 30 Amp-style female receptacle by connecting a 50 Amp load pole of the 50 Amp-style male plug to a load receptacle of the 30 Amp-style female receptacle; a neutral pole of the 50 Amp-style male plug to a neutral receptacle of the 30 Amp-style female receptacle; and a ground pole of the 50 Amp-style male plug to a ground receptacle of the 30 Amp-style female receptacle.

Another general aspect of the invention is an electrical adapter cord for electrically connecting a vehicle to a 30 Amp source of electricity. The electrical adapter cord includes: a 30 Amp-style male plug capable of connecting to a 30 Amp source of electricity via one 30 Amp load pole, and one 30 Amp neutral pole and one ground pole; a 50 Amp-style female receptacle capable of connecting to the vehicle via two 30 Amp load receptacles, and two neutral/ground receptacles; a main cable electrically connecting the 30 Amp-style male plug to the 50 Amp-style female receptacle; and a standard 110/120 volt residential receptacle having a 110/120 volt load receptacle, a 110/120 volt neutral receptacle, and a ground receptacle, the standard 110/120 volt residential receptacle being electrically connected to the 30 Amp-style male plug via an auxiliary cable, such that the 110/120 volt load receptacle is connected to a 30 Amp load pole of the 30 Amp-style male plug, the 110/120 volt neutral receptacle is connected to a 30 Amp neutral pole of the 30 Amp-style male plug, and the ground receptacle is connected to the 30 Amp ground pole of the 30 Amp-style male plug.

In some embodiments, the electrical adapter cord includes: a second standard 110/120 volt residential receptacle having a second 110/120 volt load receptacle, a second 110/120 volt neutral receptacle, and a second ground receptacle, the second standard 110/120 volt residential receptacle being electrically connected to the 30 Amp-style male plug via the auxiliary cable, such that the second 110/120 volt load receptacle is connected to the 30 Amp load pole of the 30 Amp-style male plug, the second 110/120 volt neutral receptacle is connected to the neutral pole of the 30 Amp-style male plug, and the second ground receptacle is connected to the ground pole of the 30 Amp-style male plug.

In some embodiments, the electrical adapter cord includes third and fourth standard 110/120 volt residential receptacles electrically connected to the 30 Amp-style male plug via a second auxiliary cable.

In some embodiments, the electrical adapter cord includes: a second standard 110/120 volt residential receptacle having a second 110/120 volt load receptacle, a second 110/120 volt neutral receptacle, and a second ground receptacle, the second standard 110/120 volt residential receptacle being electrically connected to the male plug via a second auxiliary cable, such that the second 110/120 volt load receptacle is connected to the load pole of the 30 Amp-style male plug, the second 110/120 volt neutral receptacle is connected to the neutral pole of the 30 Amp-style male plug, and the second ground receptacle is connected to the ground pole of the 30 Amp-style male plug.

In some embodiments, the main cable can electrically connect the 30 Amp-style male plug to the 50 Amp-style female receptacle by connecting a 30 Amp load pole of the 30 Amp-style male plug to a 50 Amp load receptacle of the 50 Amp-style female receptacle; a 30 Amp neutral pole of the 30 Amp-style male plug to a neutral receptacle of the 50 Amp-style female receptacle; a ground pole of the 30 Amp-style male plug to a ground receptacle of the 50 Amp-style female receptacle.

Yet another general aspect of the invention is an electrical adapter cord for electrically connecting a vehicle to a 30 Amp source of electricity. The electrical adapter cord includes: a male plug of a first amperage rating capable of connecting to a source of electricity via at least a load pole, a neutral pole, and a ground pole; a female receptacle of a second amperage rating capable of connecting to the vehicle via at least a load receptacle, a neutral receptacle, and a ground receptacle; a main cable electrically connecting the male plug to the female receptacle; and a standard 110/120 volt residential receptacle having a 110/120 volt load receptacle, a 110/120 volt neutral receptacle, and a ground receptacle, the standard 110/120 volt residential receptacle being electrically connected to the male plug via an auxiliary cable, such that the 110/120 volt load receptacle is connected to a load pole of the male plug, the 110/120 volt neutral receptacle is connected to a neutral pole of the male plug, and the ground receptacle is connected to a ground pole of the male plug.

In some embodiments, the electrical adapter cord includes: a second standard 110/120 volt residential receptacle having a second 110/120 volt load receptacle, a second 110/120 volt neutral receptacle, and a second ground receptacle, the second standard 110/120 volt residential receptacle being electrically connected to the male plug via the auxiliary cable, such that the second 110/120 volt load receptacle is connected to the load pole of the male plug, the second 110/120 volt neutral receptacle is connected to the neutral pole of the male plug, and the second ground receptacle is connected to the ground pole of the male plug.

In some embodiments, the electrical adapter cord includes third and fourth standard 110/120 volt residential receptacles electrically connected to the male plug of the first amperage rating via a second auxiliary cable.

In some embodiments, the electrical adapter cord includes: a second standard 110/120 volt residential receptacle having a second 110/120 volt load receptacle, a second 110/120 volt neutral receptacle, and a second ground receptacle, the second standard 110/120 volt residential receptacle being electrically connected to the male plug via a second auxiliary cable, such that the second 110/120 volt load receptacle is connected to a load pole of the male plug, the second 110/120 volt neutral receptacle is connected to a neutral pole of the male plug, and the second ground receptacle is connected to the ground pole of the male plug.

In some embodiments, the first amperage rating is 30 amperes, and the second amperage rating is 50 amperes.

In some embodiments, the first amperage rating is 50 amperes, and the second amperage rating is 30 amperes.

In some embodiments, the male plug of a first amperage rating is a 50 amp male plug capable of connecting to a source of electricity via two load poles, a neutral pole, and a ground pole, and the electrical adapter cord can further include: a second standard 110/120 volt residential receptacle having a second 110/120 volt load receptacle, a second 110/120 volt neutral receptacle, and a second ground receptacle, the second standard 110/120 volt residential receptacle being electrically connected to the male plug via a second auxiliary cable, such that the second 110/120 volt load receptacle is connected to a load pole of the male plug, the 110/120 volt neutral receptacle is connected to a neutral pole of the male plug, and the ground receptacle is connected to a ground pole of the male plug.

In some embodiments, the main cable electrically can connect the male plug to the female receptacle by connecting: a load pole of the male plug to a load receptacle of the female receptacle; a neutral pole of the male plug to a neutral receptacle of the female receptacle; and a ground pole of the male plug to a ground receptacle of the female receptacle.

In some embodiments, the main cable electrically can connect the male plug to the female receptacle by connecting: a load pole of the male plug to two connected load receptacles of the female receptacle; a neutral pole of the male plug to a neutral receptacle of the female receptacle; and a ground pole of the male plug to a ground receptacle of the female receptacle.

In some embodiments, the main cable can be covered with electrical cable casing.

BRIEF DESCRIPTION OF THE DRAWINGS

Many additional features and advantages of the present invention will be more fully understood upon reading the following detailed description, in conjunction with the following figures, wherein.

DETAILED DESCRIPTION

Figure 1:
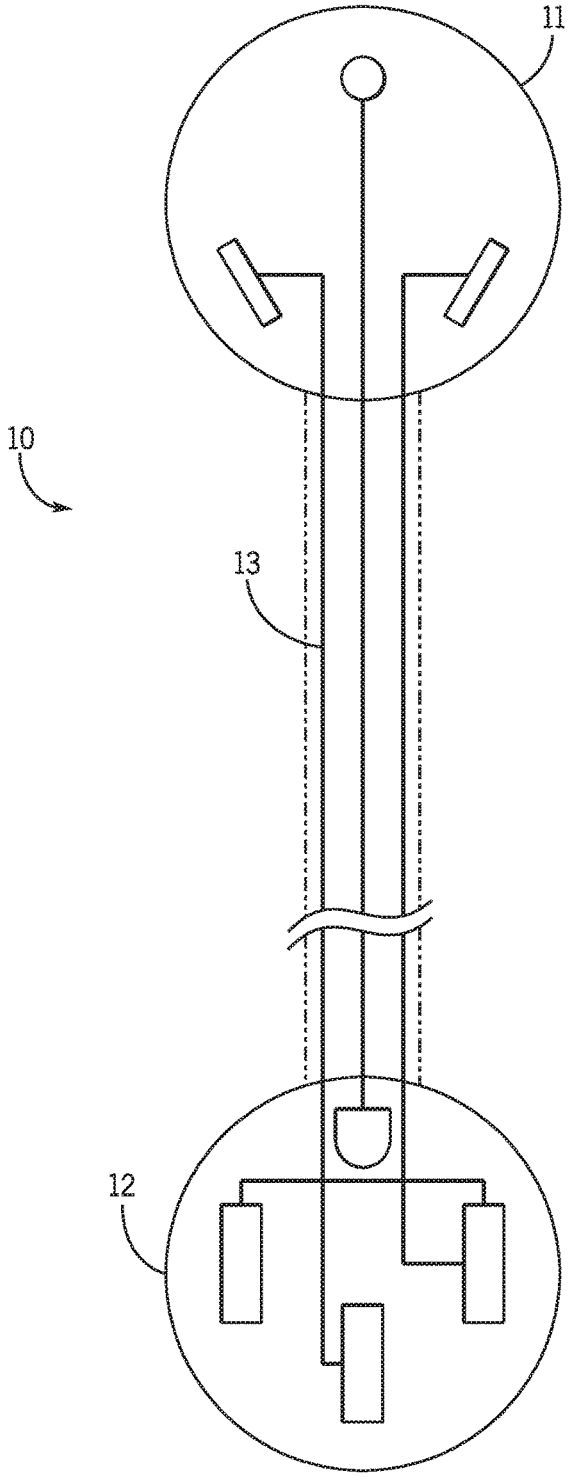
FIG. 1 is a schematic view of a prior art electrical adapter cord having a 30 Amp-style male plug and a 50 Amp-style female receptacle.
Figure 2:
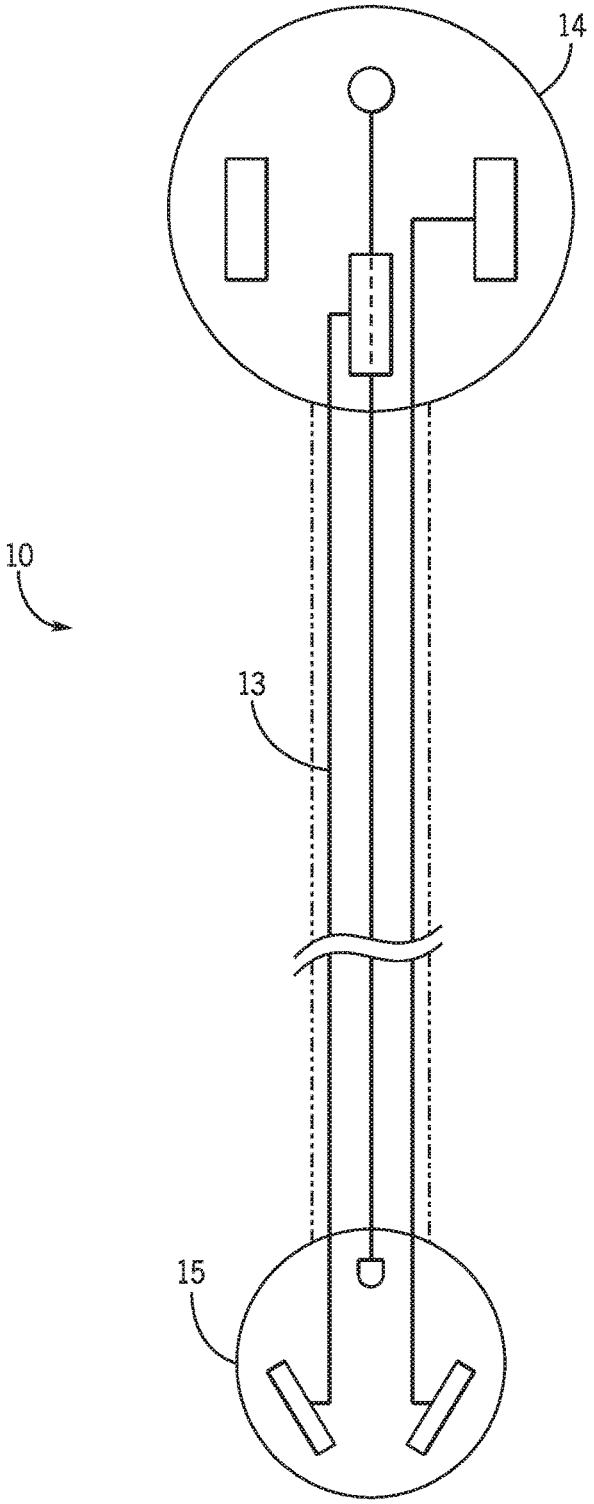
FIG. 2 is a schematic view of a prior art electrical adapter cord having a 50 Amp-style male plug and a 30 Amp-style female receptacle.
Figure 3:
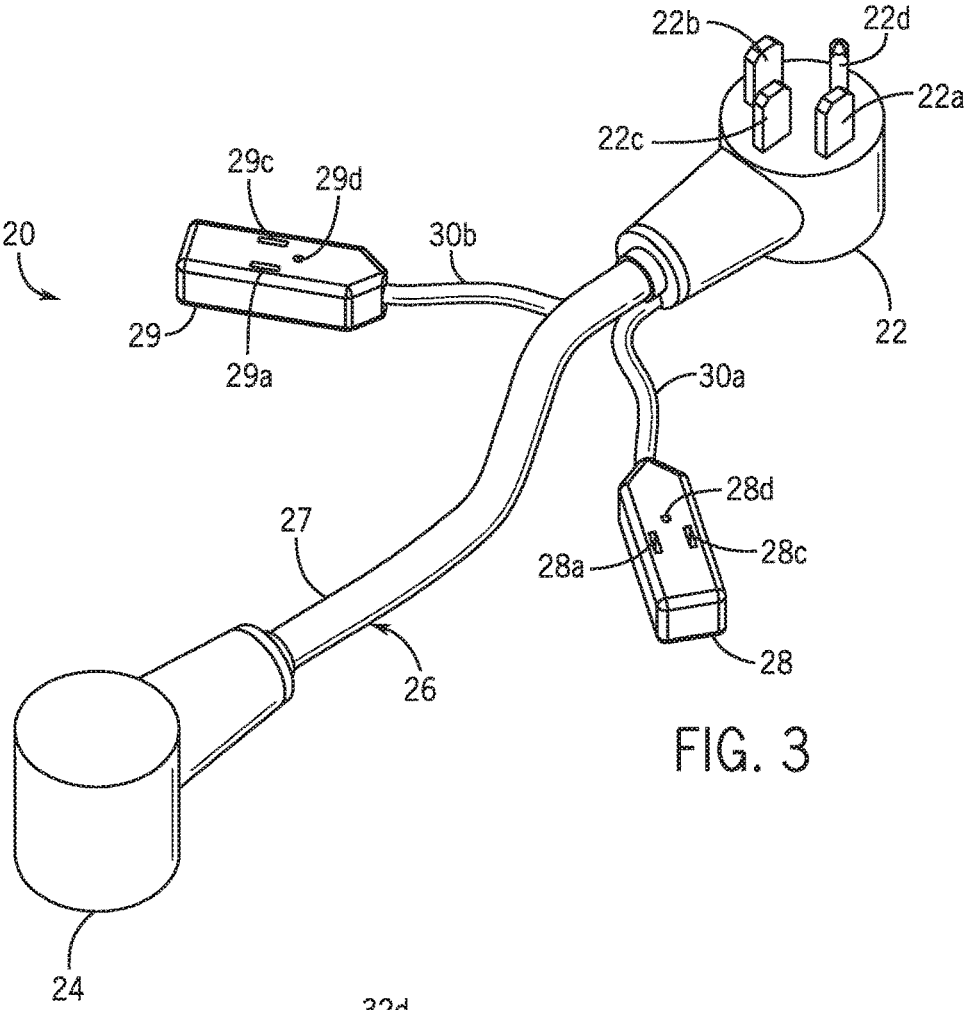
FIG. 3 is a perspective view of an exemplary implementation of the VEHICULAR ELECTRICAL ADAPTER CORD HAVING A STANDARD 110/120 VOLT RESIDENTIAL RECEPTACLE having a 50 Amp-style male plug, a 30 Amp-style amp female receptacle, and two standard 110/120 volt residential receptacles connected by respective auxiliary cables.

FIG. 3 is a perspective view of an exemplary implementation of the VEHICULAR ELECTRICAL ADAPTER CORD HAVING A STANDARD 110/120 VOLT RESIDENTIAL RECEPTACLE 20 having a 50 Amp-style male plug 22 connected to a 30 Amp-style amp female receptacle 24 via a main cable 26. A standard 110/120 volt residential receptacle 28 is electrically connected to the 50 Amp-style male plug 22 by an auxiliary cable 30*a*, and a second standard 110/120 volt residential receptacle 29 is electrically connected to the 50 Amp-style male plug 22 by an auxiliary cable 30*b*.

While the VEHICULAR ELECTRICAL ADAPTER CORD HAVING A STANDARD 110/120 VOLT RESIDENTIAL RECEPTACLE is described using 50 Amp-style and 30 amp style plugs and receptacles, is noted that any Amp-style plugs and receptacles could be used. For example, 30 Amp-style and 50 amp style plugs and receptacles could be used. Also, while the VEHICULAR ELECTRICAL ADAPTER CORD HAVING A STANDARD 110/120 VOLT RESIDENTIAL RECEPTACLE is described as being used with a recreational vehicle (RV) and a power board for an RV, the VEHICULAR ELECTRICAL ADAPTER CORD HAVING A STANDARD 110/120 VOLT RESIDENTIAL RECEPTACLE could be used with any type of vehicle and suitable power source.

The 50 Amp-style male plug 22 can electrically connect to a 50 Amp source of electricity such as, for example, a power board for a recreational vehicle (RV). As shown in FIG. 3, the 50 Amp-style male plug 22 includes a first 50 Amp load pole 22*a*, a second 50 Amp load pole 22*b*, a neutral pole 22*c*, and a ground pole 22*d*.

The 30 Amp-style female receptacle 24 can electrically connect to a vehicle such as, for example, an RV. The 30 Amp-style female receptacle 24 includes a 30 Amp load receptacle 24*a*, a 30 Amp neutral receptacle 24*c*, and a ground receptacle 24*d*. The 30 Amp-style female receptacle 24 is electrically connected to the 50 Amp-style male plug 22 via a main cable 26. The main cable 26 may be covered with an electrical cable casing 27.

A first standard 110/120 volt residential receptacle 28 is electrically connected to the 50 Amp-style male plug via an auxiliary cable 30*a*. The first standard 110/120 volt residential receptacle 28 includes a first 110/120 volt load receptacle 28*a*, a first 110/120 volt neutral receptacle 28*c*, and a first ground receptacle 28*d*.

Figure 5:
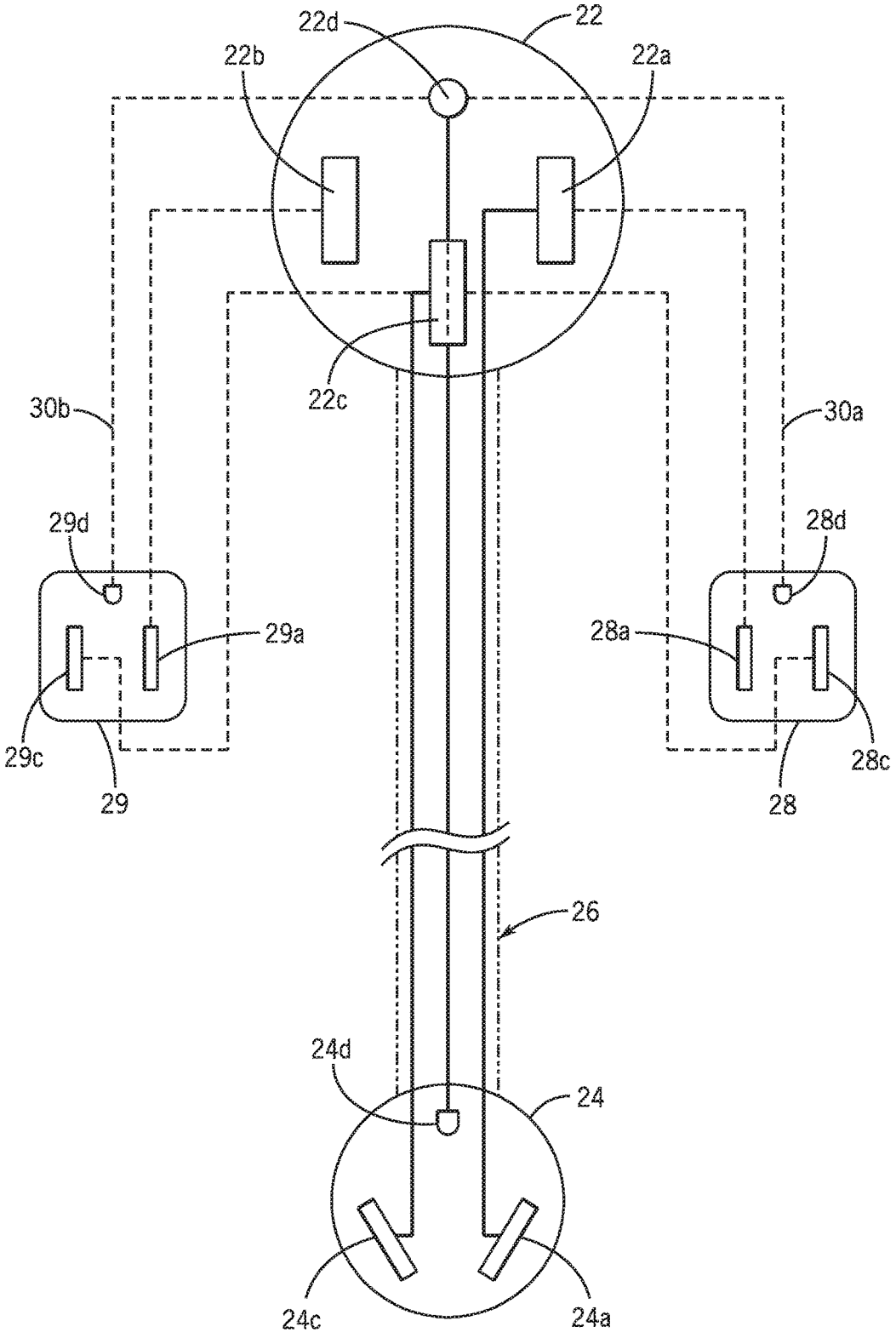
FIG. 5 is a schematic view of the VEHICULAR ELECTRICAL ADAPTER CORD HAVING A STANDARD 110/120 VOLT RESIDENTIAL RECEPTACLE of FIG. 3.

The electrical connections between the 50 Amp-style male plug 22 and 30 Amp-style female receptacle 24 and the first standard 110/120 volt residential receptacle 28 are illustrated in the schematic view shown in FIG. 5. The 50 Amp-style male plug 22 and 30 Amp-style female receptacle 24 are electrically connected by electrically connecting the first 50 Amp load pole 22*a* of the 50 Amp-style male plug 22 to the 30 Amp load receptacle 24*a* of the 30 Amp-style female receptacle 24, electrically connecting the neutral pole 22*c* of the 50 Amp-style male plug 22 to the 30 Amp neutral receptacle 24*c* of the 30 Amp-style female receptacle 24, and electrically connecting the ground pole 22*d* of the 50 Amp-style male plug 22 to the ground receptacle 24*d* of the 30 Amp-style female receptacle 24.

The 50 Amp-style male plug 22 and the first standard 110/120 volt residential receptacle 28 are electrically connected by electrically connecting the first 110/120 volt load receptacle 28*a* to the first 50 Amp load pole 22*a*, electrically connecting the first 110/120 volt neutral receptacle 28*c* to the neutral pole 22*c*, and electrically connecting the first 110/120 volt ground receptacle 28*d* to the ground pole 22*d*.

In FIG. 3, a second standard 110/120 volt residential receptacle 29 can be electrically connected to the 50 Amp-style male plug 22 via a second auxiliary cable 30*b*. The second standard 110/120 volt residential receptacle 29 includes a second 110/120 volt load receptacle 29*a*, a second 110/120 volt neutral receptacle 29*c*, and a second ground receptacle 29*d*.

As shown in FIG. 5, the 50 Amp-style male plug 22 and the second standard 110/120 volt residential receptacle 29 are electrically connected by electrically connecting the second 110/120 volt load receptacle 29*a* to the second 50 Amp load pole 22*b* of the 50 Amp-style male plug 22, electrically connecting the second 110/120 volt neutral receptacle 29*c* to the neutral pole 22*c*, and electrically connecting the second 110/120 volt ground receptacle 29*d* to the ground pole 22*d*.

Figure 4:
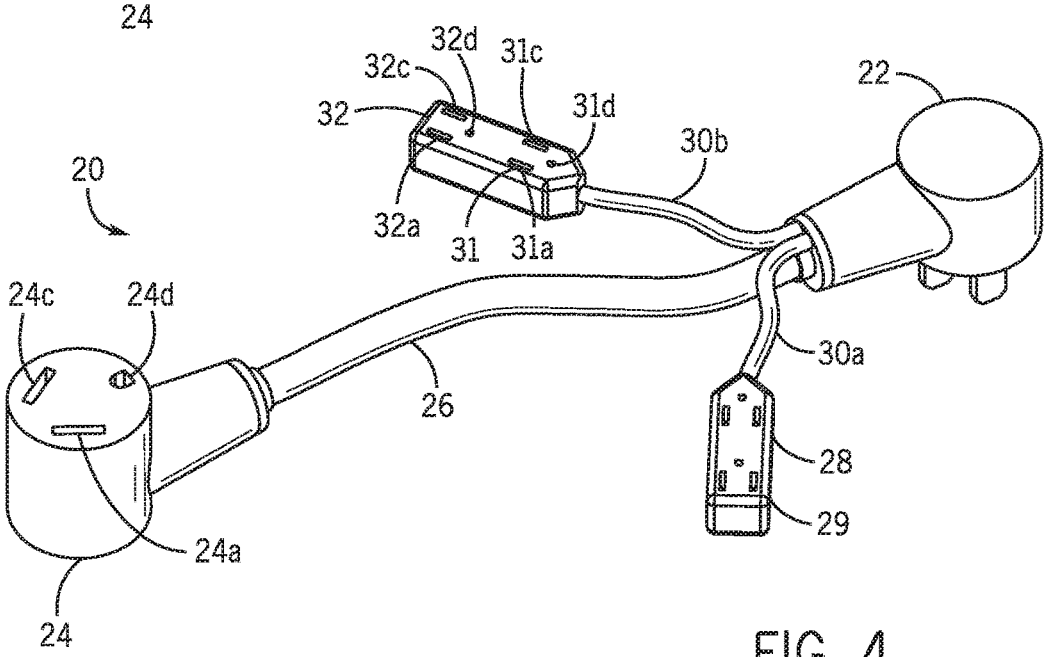
FIG. 4 is a perspective view of an exemplary implementation of the VEHICULAR ELECTRICAL ADAPTER CORD HAVING A STANDARD 110/120 VOLT RESIDENTIAL RECEPTACLE having a 50 Amp-style male plug, a 30 Amp-style amp female receptacle, and two auxiliary cables, each having two standard 110/120 volt residential receptacles.

FIG. 4 further shows a perspective view of an alternative exemplary implementation in which a first standard 110/120 volt residential receptacle 28 and a second standard 110/120 volt residential receptacle 29 are electrically connected in parallel to the 50 Amp-style male plug 22 by an auxiliary cable 30*a*, as set forth above with respect to receptacle 28 FIG. 3. Also, the use of first and second standard 110/120 volt receptacles connected in parallel is not intended to be limiting, and three or four standard 110/120 volt receptacles could be connected in parallel to the 50 Amp-style male plug 22 via the auxiliary cable 30*a*, for example.

In this exemplary implementation, the 50 Amp-style male plug 22 is electrically connected to the first standard 110/120 volt residential receptacle 28 and the second standard 110/120 volt residential receptacle 29 by electrically connecting the first 50 Amp load pole 22*a* to both the first 110/120 volt load receptacle 28*a* and the second 110/120 volt load receptacle 29*a*, electrically connecting the neutral pole 22*c* to the first 110/120 volt neutral receptacle 28*c* and the second 110/120 volt neutral receptacle 29*c*, and electrically connecting the ground pole 22*d* to the first 110/120 volt ground receptacle 28*d* and the second 110/120 volt ground receptacle 29*d*.

In an alternative exemplary implementation, as shown in FIG. 4, a third standard 110/120 volt residential receptacle 31 and a fourth standard 110/120 volt residential receptacle 32 can be electrically connected to the 50 Amp-style male plug 22 via a second auxiliary cable 30*b*. The third standard 110/120 volt residential receptacle 31 includes a third 110/120 volt load receptacle 31*a*, a third 110/120 volt neutral receptacle 31*c*, and a third ground receptacle 31*d*. The fourth standard 110/120 volt residential receptacle 32 includes a fourth 110/120 volt load receptacle 32*a*, a fourth 110/120 volt neutral receptacle 32*c*, and a fourth ground receptacle 32*d*.

In this exemplary implementation, the 50 Amp-style male plug 22 is electrically connected to the third standard 110/120 volt residential receptacle 31 and the fourth standard 110/120 volt residential receptacle 32 by electrically connecting the second 50 Amp load pole 22*b* to both the third 110/120 volt load receptacle 31*a* and the forth 110/120 volt load receptacle 32*a*, electrically connecting the neutral pole 22*c* to the third 110/120 volt neutral receptacle 31*c* and the fourth 110/120 volt neutral receptacle 32*c*, and electrically connecting the ground pole 22*d* to the third 110/120 volt ground receptacle 31*d* and the fourth 110/120 volt ground receptacle 32*d*.

Figure 6:
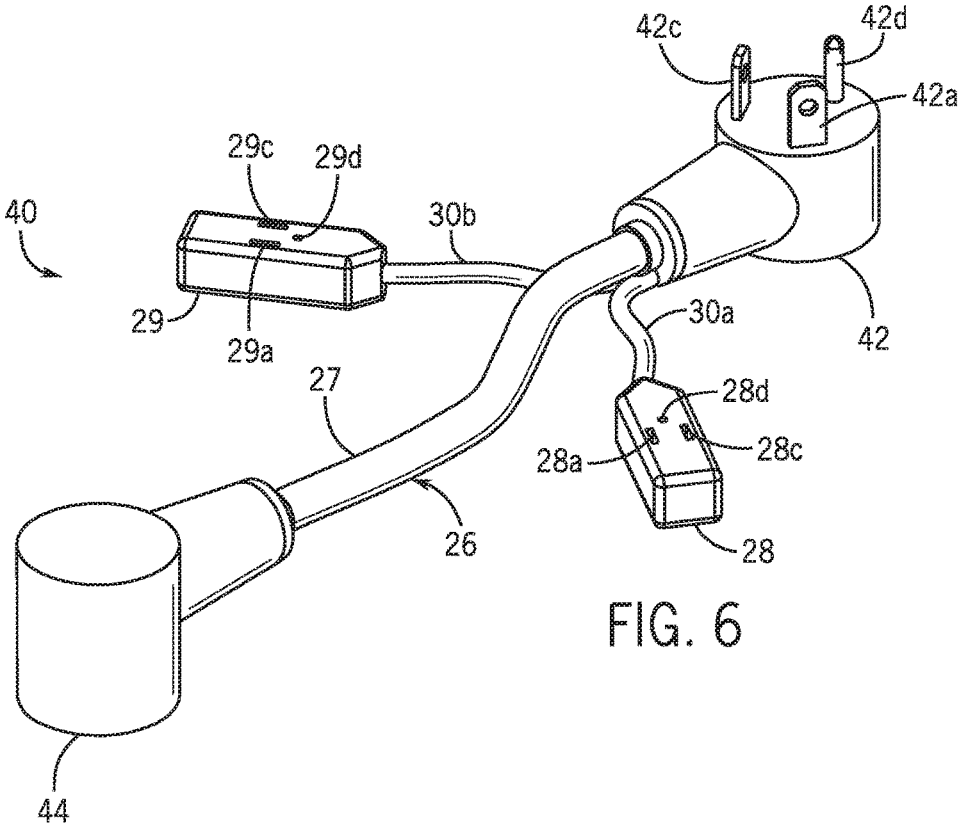
FIG. 6 is a perspective view of an exemplary implementation of the VEHICULAR ELECTRICAL ADAPTER CORD HAVING A STANDARD 110/120 VOLT RESIDENTIAL RECEPTACLE having a 30 Amp-style male plug, a 50 Amp-style amp female receptacle, and two standard 110/120 volt residential receptacles, each connected by a respective auxiliary cable.

FIG. 6 is a perspective view of an exemplary implementation of the VEHICULAR ELECTRICAL ADAPTER CORD HAVING A STANDARD 110/120 VOLT RESIDENTIAL RECEPTACLE 40 having a 30 Amp-style male plug 42 connected to a 50 Amp-style amp female receptacle 44 via a main cable 26. Standard 110/120 volt residential receptacles 28 and 29 are electrically connected to the 30 Amp-style male plug 42 by auxiliary cables 30*a* and 30*b*, respectively.

The 30 Amp-style male plug 42 can electrically connect to a 30 Amp source of electricity such as, for example, a power board in an RV Park for recreational vehicles. As shown in FIG. 6, the 30 Amp-style male plug 42 includes a 30 Amp load pole 42*a*, a neutral pole 42*c*, and a ground pole 42*d*.

The 50 Amp-style female receptacle 44 can electrically connect to a vehicle, such as an RV. The 50 Amp-style female receptacle 44 includes a first 50 Amp load receptacle 44*a* connected to a second 50 Amp load receptacle 44*b*, a 50 Amp neutral receptacle 44*c*, and a ground receptacle 44*d*. The 50 Amp-style female receptacle 44 is electrically connected to the 30 Amp-style male plug 42 via a main cable 26. The main cable 26 may be covered with an electrical cable casing 27.

A first standard 110/120 volt residential receptacle 28 is electrically connected to the 30 Amp-style male plug via an auxiliary cable 30*a*. The first standard 110/120 volt residential receptacle 28 includes a first 110/120 volt load receptacle 28*a*, a first 110/120 volt neutral receptacle 28*c*, and a first ground receptacle 28*d*.

Figure 8:
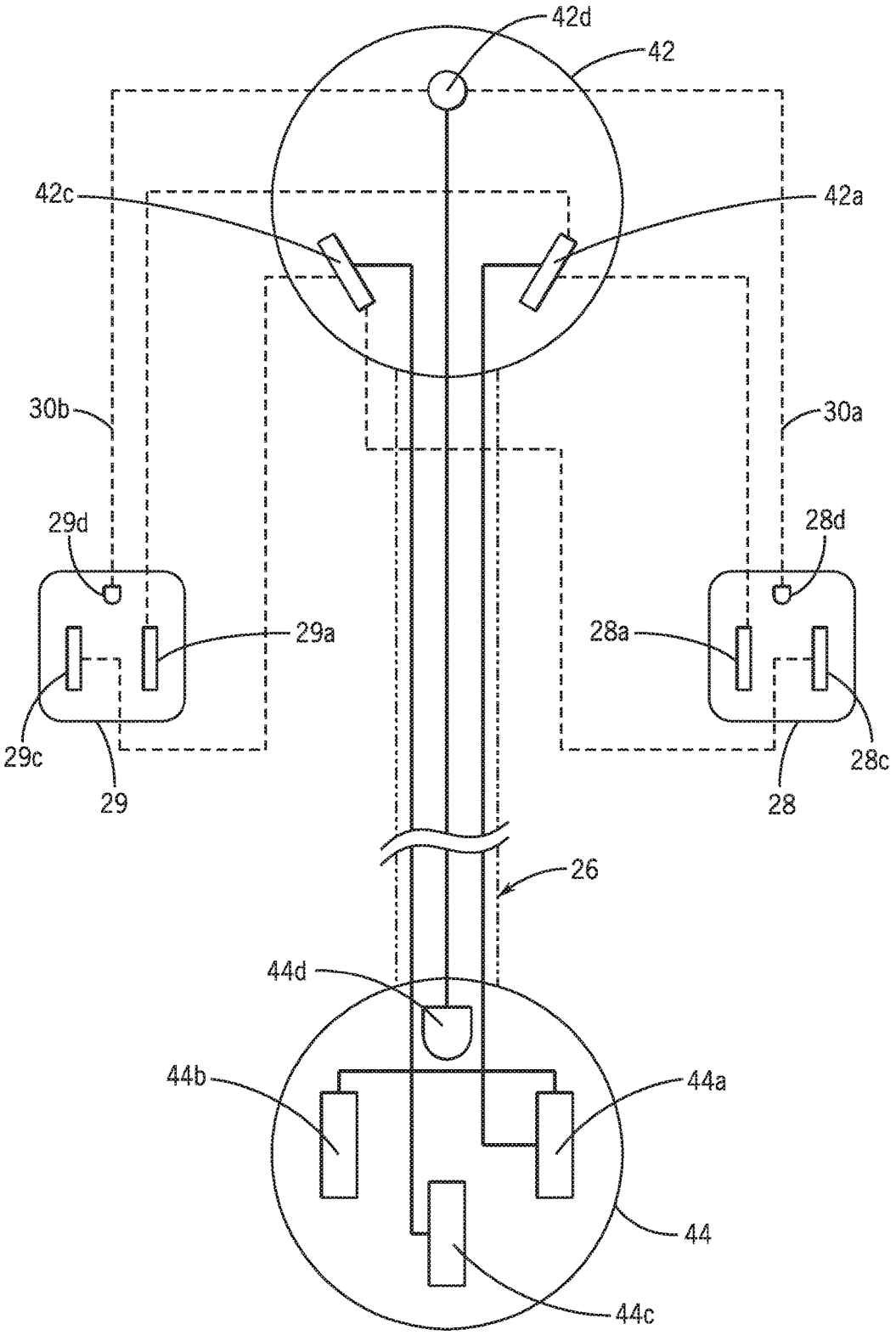
FIG. 8 is a schematic view of the VEHICULAR ELECTRICAL ADAPTER CORD HAVING A STANDARD 110/120 VOLT RESIDENTIAL RECEPTACLE of FIG. 6.

The electrical connections between the 30 Amp-style male plug 42 and 50 Amp-style female receptacle 44 and the first standard 110/120 volt residential receptacle 28 are illustrated in the schematic view shown in FIG. 8. The 30 Amp-style male plug 42 and 50 Amp-style female receptacle 44 are electrically connected by electrically connecting the 30 Amp load pole 42*a* of the 30 Amp-style male plug 42 to the 50 Amp load receptacle 44*a* of the 50 Amp-style female receptacle 44, electrically connecting the neutral pole 42*c* of the 30 Amp-style male plug 42 to the 30 Amp neutral receptacle 44*c* of the 50 Amp-style female receptacle 44, and electrically connecting the ground pole 42*d* of the 30 Amp-style male plug 42 to the ground receptacle 44*d* of the 50 Amp-style female receptacle 44.

The 30 Amp-style male plug 42 and the first standard 110/120 volt residential receptacle 28 are electrically connected by electrically connecting the first 110/120 volt load receptacle 28*a* to the 30 Amp load pole 42*a*, electrically connecting the first 110/120 volt neutral receptacle 28*c* to the neutral pole 42*c*, and electrically connecting the first 110/120 volt ground receptacle 28*d* to the ground pole 42*d*.

Also shown in FIG. 6, a second standard 110/120 volt residential receptacle 29 is electrically connected to the 30 Amp-style male plug 42 via a second auxiliary cable 30*b*. The second standard 110/120 volt residential receptacle 29 includes a second 110/120 volt load receptacle 29*a*, a second 110/120 volt neutral receptacle 29*c*, and a second ground receptacle 29*d*.

As shown in FIG. 8, the 30 Amp-style male plug 42 and the second standard 110/120 volt residential receptacle 29 are electrically connected by electrically connecting the second 110/120 volt load receptacle 29*a* to the 30 Amp load pole 42*a* of the 30 Amp-style male plug 42, electrically connecting the second 110/120 volt neutral receptacle 29*c* to the neutral pole 42*c*, and electrically connecting the second 110/120 volt ground receptacle 29*d* to the ground pole 42*d*.

Figure 7:
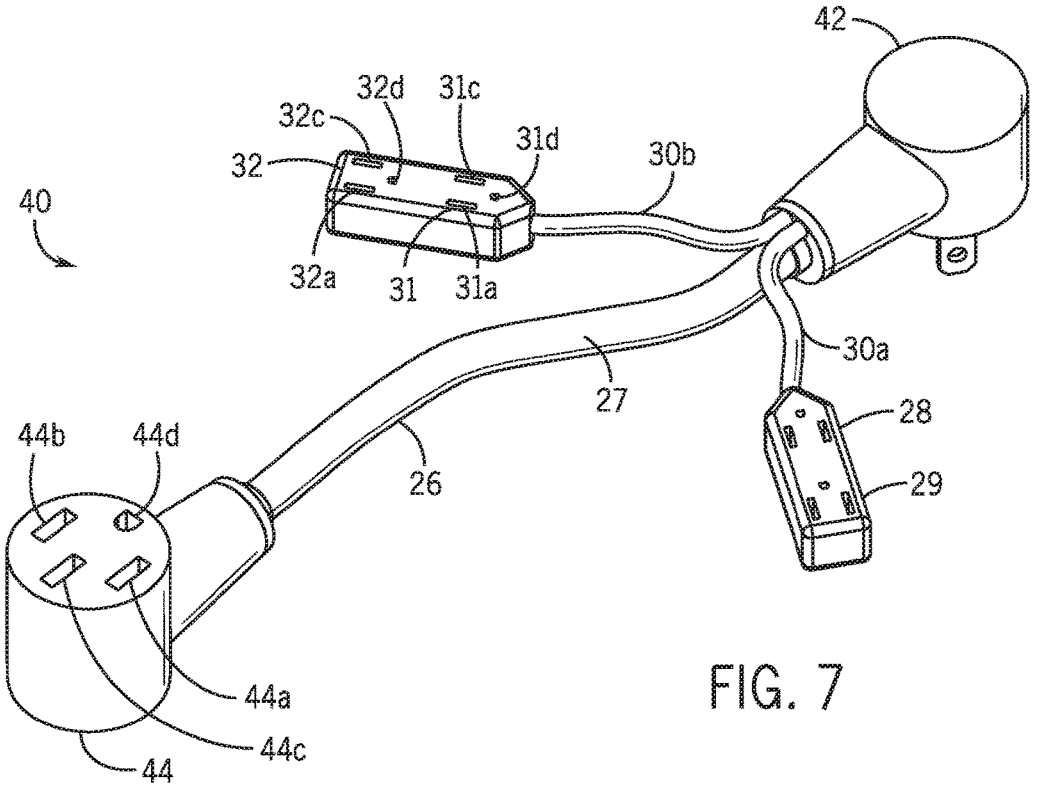
FIG. 7 is a perspective view of an exemplary implementation of the VEHICULAR ELECTRICAL ADAPTER CORD HAVING A STANDARD 110/120 VOLT RESIDENTIAL RECEPTACLE having a 30 Amp-style male plug, a 50 Amp-style amp female receptacle, and two auxiliary cables, each having two standard 110/120 volt residential receptacles.

FIG. 7 shows a perspective view of an embodiment wherein both a first standard 110/120 volt residential receptacle 28 and a second standard 110/120 volt residential receptacle 29 are electrically connected in parallel to the 30 Amp-style male plug 42 by an auxiliary cable 30*a*. The descriptions of the first standard 110/120 volt residential receptacle 28 and the second standard 110/120 volt residential receptacle 29 are essentially as set forth above with respect to FIGS. 3 and 6. Also, the use of first and second standard 110/120 volt receptacles is not intended to be limiting, and more than two standard 110/120 volt receptacles could be connected in parallel to the 30 Amp-style male plug 42 by the auxiliary cable 30*a*.

In this embodiment, referring to FIG. 8, the 30 Amp-style male plug 42 is electrically connected to both the first standard 110/120 volt residential receptacle 28 and the second standard 110/120 volt residential receptacle 29 by electrically connecting the 30 Amp load pole 42*a* to both the first 110/120 volt load receptacle 28*a* and the second 110/120 volt load receptacle 29*a*, electrically connecting the neutral pole 42*c* to the first 110/120 volt neutral receptacle 28*c* and the second 110/120 volt neutral receptacle 29*c*, and electrically connecting the ground pole 42*d* to the first 110/120 volt ground receptacle 28*d* and the second 110/120 volt ground receptacle 29*d*.

In the embodiment shown in FIG. 7, a third standard 110/120 volt residential receptacle 31 and a fourth standard 110/120 volt residential receptacle 32 are electrically connected to the 30 Amp-style male plug 42 via a second auxiliary cable 30*b*. The third standard 110/120 volt residential receptacle 31 includes a third 110/120 volt load receptacle 31*a*, a third 110/120 volt neutral receptacle 31*c*, and a third ground receptacle 31*d*. The fourth standard 110/120 volt residential receptacle 32 includes a fourth 110/120 volt load receptacle 32*a*, a fourth 110/120 volt neutral receptacle 32*c*, and a fourth ground receptacle 32*d*.

In this embodiment, the 30 Amp-style male plug 42 is electrically connected to the third standard 110/120 volt residential receptacle 31 and the fourth standard 110/120 volt residential receptacle 32 by electrically connecting the 30 Amp load pole 42*a* to the third 110/120 volt load receptacle 31*a* and forth 110/120 volt load receptacle 32*a*, electrically connecting the neutral pole 42*c* to the third 110/120 volt neutral receptacle 31*c* and the fourth 110/120 volt neutral receptacle 32*c*, and electrically connecting the ground pole 42*d* to the third 110/120 volt ground receptacle 31*d* and the fourth 110/120 volt ground receptacle 32*d*.

Other modifications and implementations will occur to those skilled in the art without departing from the spirit and the scope of the invention as claimed. Accordingly, the above description is not intended to limit the invention, except as indicated in the following claims.

What is claimed is:

1. An electrical adapter cord for electrically connecting a recreational vehicle to a 50 Amp receptacle of a recreational vehicle park power board, the electrical adapter cord comprising:

a 50 Amp-style male plug capable of mating engagement with a corresponding female receptacle of the recreational vehicle park power board, the 50 Amp-style male plug having first and second straight-blade load poles, a straight-blade neutral pole, and a ground pole, wherein the first and second straight-blade load poles extend from a face of the 50 Amp-style male plug and are generally parallel with one another;

a 30 Amp-style female receptacle capable of mating engagement with a corresponding male plug of the recreational vehicle, the 30 Amp-style female receptacle having a straight-slot load receptacle, a straight-slot neutral receptacle, and a ground receptacle, wherein the straight-slot load receptacle and the straight-slot neutral receptacle of the 30 Amp-style female receptacle are canted toward one another;

a main cable electrically connecting the first straight-blade load pole of the 50 Amp-style male plug with the straight-slot load receptacle of the 30 Amp-style female receptacle, the straight-blade neutral pole of the 50 Amp-style male plug with the straight-slot neutral receptacle of the 30 Amp-style female receptacle, and the straight-blade neutral pole of the 50 Amp-style male plug with the ground receptacle of the 30 Amp-style female receptacle;

a standard 110/120 volt residential receptacle having a straight-slot load receptacle, a straight-slot neutral receptacle, and a ground receptacle;

an auxiliary cable electrically connecting the first straight-blade load pole of the 50 Amp-style male plug with the straight-slot load receptacle of the standard 110/120 volt residential receptacle, the straight-blade neutral pole of the 50 Amp-style male plug with the straight-slot neutral receptacle of the 110/120 volt residential receptacle, and the straight-blade neutral pole of the 50 Amp-style male plug with the ground receptacle of the standard 110/120 volt receptacle; and wherein the main cable and auxiliary cable separately extend from the 50 Amp-style male plug and are pliable so that they are independently movable with respect to one another thereby allowing the 30 Amp-style female receptacle and standard 110/120 volt residential receptacle to be freely move between differing locations.

2. The electrical adapter cord of claim 1, further comprising:

a second standard 110/120 volt residential receptacle molded with the standard 110/120 volt residential receptacle, wherein the second standard 110/120 volt residential receptacle is electrically connected to the 50 Amp-style male plug in parallel with the standard 110/120 volt residential receptacle using the auxiliary cable.

3. The electrical adapter cord of claim 2, further comprising:

third and fourth standard 110/120 volt residential receptacles electrically connected to the 50 Amp-style male plug in parallel with one another via a second auxiliary cable, wherein the main cable, auxiliary cable, and second auxiliary cable are pliable and independently movable with respect one another.

4. The electrical adapter cord of claim 1, further comprising:

a second standard 110/120 volt residential receptacle having a second load receptacle, a second neutral receptacle, and a second ground receptacle, the second standard 110/120 volt residential receptacle being electrically connected to the 50 Amp-style male plug via a second auxiliary cable, such that the load receptacle of the second standard 110/120 volt residential receptacle is connected to the second load pole of the 50 Amp-style male plug, the second neutral receptacle of the second standard 110/120 volt residential receptacle is connected to the neutral pole of the 50 Amp-style male plug, and the second ground receptacle of the second standard 110/120 volt residential receptacle is connected to the ground pole of the 50 Amp-style male plug.

5. An electrical adapter cord for electrically connecting a recreational vehicle to a receptacle of a recreational vehicle park power board, the electrical adapter cord comprising:

a male plug of a first amperage rating capable of connecting to the recreational vehicle park power board via at least a load pole, a neutral pole, and a ground pole;

a female receptacle of a second amperage rating capable of connecting to the recreational vehicle via at least a load receptacle, a neutral receptacle, and a ground receptacle;

a main cable electrically connecting the load pole, neutral pole, and ground pole of the male plug to the load receptacle, neutral receptacle, and ground receptacle of the female receptacle;

a standard 110/120 volt residential receptacle having a load receptacle, a neutral receptacle, and a ground receptacle; and an auxiliary cable electrically connecting the load pole of the male plug to the load receptacle of the standard 110/120 volt residential receptacle, the neutral pole of the male plug to the neutral receptacle of the standard 110/120 volt residential receptacle, and the ground pole of the male plug to the ground receptacle of the standard 110/120 volt residential receptacle;

wherein the main cable and auxiliary cable separately extend from the male plug and are pliable so that they are independently movable with respect to one another thereby allowing the female receptacle and standard 110/120 volt residential receptacle to be freely move between differing locations.

6. The electrical adapter cord of claim 5, further comprising:

a second standard 110/120 volt residential receptacle having a second 110/120 volt load receptacle, a second 110/120 volt neutral receptacle, and a second ground receptacle, the second standard 110/120 volt residential receptacle being molded with the standard 110/120 volt residential receptacle, wherein the second standard 110/120 volt residential receptacle is electrically connected to the male plug in parallel with the standard 110/120 volt residential receptacle using the auxiliary cable.

7. The electrical adapter cord of claim 6, further comprising:

third and fourth standard 110/120 volt residential receptacles electrically connected to the male plug of the first amperage rating in parallel with one another via a second auxiliary cable, wherein the main cable, auxiliary cable, and a 2nd auxiliary cable are pliable and independently movable with respect one another.

8. The electrical adapter cord of claim 5, wherein the first amperage rating is 30 amperes, and the second amperage rating is 50 amperes.

9. An electrical adapter cord for electrically connecting a recreational vehicle to a 30 Amp female receptacle of a recreational vehicle park power board, the electrical adapter cord comprising:

a 50 Amp-style female receptacle capable of mating engagement with a corresponding 50 Amp-style male receptacle, the 50 Amp-style female receptacle having first and second straight-slot load receptacles, a straight-slot neutral receptacle, and a ground receptacle, wherein the first and second straight-slot load receptacles are generally parallel with one another;

a 30 Amp-style male plug capable of mating engagement with a corresponding 30 Amp-style female receptacle of the recreational vehicle park power board, the 30 Amp-style male plug having a straight-blade load pole, a straight-blade neutral pole, and a ground pole, wherein the straight-blade load pole and the straight-blade neutral pole of the 30 Amp-style male receptacle are canted toward one another;

a main cable electrically connecting the first and second straight-slot load receptacles of the 50 Amp-style female receptacle with the straight-blade pole of the 30 Amp-style male plug, the straight-slot neutral receptacle of the 50 Amp-style female receptacle with the straight-blade neutral pole of the 30 Amp-style male plug, and the straight-slot neutral receptacle of the 50 Amp-style female receptacle with the ground pole of the 30 Amp-style male plug;

a standard 110/120 volt residential receptacle having a straight-slot load receptacle, a straight-slot neutral receptacle, and a ground receptacle;

an auxiliary cable electrically connecting the straight-blade load pole of the 30 Amp-style male plug with the straight-slot load receptacle of the standard 110/120 volt residential receptacle, the straight-blade neutral pole of the 30 Amp-style male plug with the straight-slot neutral receptacle of the 110/120 volt residential receptacle, and the straight-blade neutral pole of the 30 Amp-style male plug with the ground receptacle of the standard 110/120 volt receptacle; and wherein the main cable and auxiliary cable separately extend from the 30 Amp-style male plug and are pliable so that they are independently movable with respect to one another thereby allowing the 30 Amp-style male plug and standard 110/120 volt residential receptacle to be freely move between differing locations.

* * * * *